US010883322B2

(12) United States Patent
Gray-Stephens et al.

(10) Patent No.: US 10,883,322 B2
(45) Date of Patent: Jan. 5, 2021

(54) PORTABLE STAND BUILDING WINCH

(71) Applicant: Frank's International, LLC, Houston, TX (US)

(72) Inventors: Malcolm Graham Stedman Gray-Stephens, Aberdeenshire (GB); Dougal Brown, Scotland (GB)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 136 days.

(21) Appl. No.: 16/191,278

(22) Filed: Nov. 14, 2018

(65) Prior Publication Data

US 2020/0149359 A1 May 14, 2020

(51) Int. Cl.
*E21B 19/084* (2006.01)
*E21B 19/00* (2006.01)

(52) U.S. Cl.
CPC ..... *E21B 19/084* (2013.01); *E21B 19/008* (2013.01)

(58) Field of Classification Search
CPC ..... E21B 19/084; E21B 19/008; E21B 19/02; E21B 19/00; E21B 19/08; E21B 19/06; E21B 19/14
See application file for complete search history.

(56) References Cited

U.S. PATENT DOCUMENTS

| | | | | |
|---|---|---|---|---|
| 2,999,605 | A * | 9/1961 | De Jarnett | E21B 19/155 414/22.55 |
| 5,468,121 | A * | 11/1995 | Stogner | E21B 19/14 166/77.51 |
| 6,209,851 | B1 * | 4/2001 | Eilertsen | E21B 19/14 254/338 |
| 7,677,856 | B2 * | 3/2010 | Standal | E21B 19/14 414/22.63 |
| 8,052,370 | B2 * | 11/2011 | Dekker | E21B 19/146 414/22.66 |
| 9,303,468 | B2 * | 4/2016 | Selzer | E21B 19/06 |
| 2014/0251686 | A1 * | 9/2014 | Birkeland | E21B 19/143 175/5 |
| 2017/0362904 | A1 * | 12/2017 | Unander | E21B 19/008 |

* cited by examiner

*Primary Examiner* — Michael R Wills, III
(74) *Attorney, Agent, or Firm* — MH2 Technology Law Group LLP

(57) ABSTRACT

A portable apparatus for vertically positioning tubulars in a mousehole of a drilling rig includes a main body housing a winch and an anchor point. The main body is configured to be radially aligned with the mousehole. The apparatus also includes a float assembly which is suspended within the mousehole below the main body and a cable wound onto the winch. The cable extends downward into the mousehole traversing the mousehole at the float assembly and then extends upward to and attached to the anchor point on the main body.

30 Claims, 17 Drawing Sheets

PORTABLE STAND BUILDING WINCH

BACKGROUND

In oilfield tubular-running operations, lengths of pipe are joined together, end-on-end, to form a contiguous tubular string (e.g., drill string, casing string, etc.). Each string is progressively fed into a wellbore at different times during drilling operations, well casing operations or completion operations. Each tubular type varies in typical length. For example, drill pipe tubular segments are typically 30 ft. in length, whereas casing tubular segments can vary in length from 32 ft. to 46 ft. approximately. Completion tubing varies in length as well from 32 ft. to 42 ft. approximately.

In order to decrease the time required to assemble a complete string of tubulars and lower the string into the wellbore it has become common practice the preassemble multiple segments of tubulars together, which are then referred to as "stands." A typical stand is made up of three tubular segments but in some cases can be two tubular segments. In order to further decrease the time required to assemble the tubular string the tubular stands are positioned vertically adjacent to the wellbore in a framework that is part of the rig structure. In order to provide a space on the rig floor where individual tubular segments can be joined together into stands, a common solution has been to provide a shallow bore hole adjacent to the wellbore at the center of the rig, into which such pipe segments are inserted in a generally vertical orientation to facilitate makeup of additional tubular segments into a stand. The shallow bore hole structure portion of the rig is known as a "mousehole".

Rigs generally provide a system for vertically supporting, raising and lowering tubulars in the mousehole portion of the rig floor to facilitate the assembly of the individual segments into a stand. The mousehole opening in the rig floor normally has a sleeve (sock) that is structurally suspended beneath the opening. The sleeve or sock is a fixed length closed tube and can range in depth so as to accommodate housing a single tubular segment or up to three tubular segments.

Further, some rigs are configured to have powered slip type gripping tools at the rig floor elevation that are used to grip and suspend pipe vertically in the mousehole with the bottom of the pipe some distance from the bottom of the sleeve. A tubular elevator is used to raise and lower the tubulars in to the mousehole. The tubular elevator is suspended via a hoisting system above the mousehole. The slips and gripping inserts of the powered slip type gripping tools used within them can cause damage to the pipe surface. Causing damage to the surface of these tubulars is undesirable particularly with respect to CRA (Corrosion Resistant Alloy) type casing and tubing.

Some rigs like these lack a "stop" or "float" in the mousehole, and instead rely on slip-type gripping tools that are susceptible to inadvertent opening of the slip type tool. An inadvertent opening of the slip type tool results in a release of the tubular being supported, thus allowing the tubular to be dropped to the bottom of the mousehole. This can result in damage to the tubular, particularly the threaded end connection at the lowermost portion of the tubular. The inadvertent release of a tubular can also result in damage to the mousehole sock as well.

More recently some rigs incorporate more sophisticated mouseholes in terms of tubular handling. Included in these more recently manufactured rigs are mouseholes with elevating mechanisms that can raise and lower a stop in the mousehole. The stop can in turn serve to provide vertical support to tubulars that are positioned in the mousehole.

It is desirable to provide a similar system to vertically position and support bottom tubulars in mouseholes of older rigs that are not equipped with elevating mechanisms as described above. This is particularly desirable in situations where CRA tubulars are being run to avoid the need for slip-type gripping tools, which cause damage to the outer surface of these type tubulars.

This system introduces a powered, vertically float assembly in the mousehole sock on those rigs that are not equipped with powered, elevating mechanisms in the mousehole, without the need for modification to the rig or the mousehole. This system can be used inside of an auxiliary rotary which has been fitted as well with a "sock" similar to that of a mousehole as well and as such is not limited to use only in a mousehole. The float assembly supports the pipe or assemblage of pipe some distance from the bottom of the mousehole so that the length of pipe sticking out above the rig floor can be controlled. This is desirable as it supports the pipe in the mousehole such that the length of pipe protruding above the rig floor is controlled and can be made to be repeatable. Controlling the length of pipe protruding above the rig floor makes easier to carry out operations involving the top of the pipe.

The state of the art includes U.S. Pat. No. 9,309,727, which discloses a mousehole apparatus having a main body (mousehole sock) configured for holding a drill pipe or similar elongate element. The apparatus includes a carrier which is similar to the "float" previously mentioned that is connected to a deck structure and having a support region adapted for releasable supportive interaction with an abutment element on the main body. The carrier includes guiding devices for the main body and movement means operable to move the main body with respect to the carrier. However, in U.S. Pat. No. 9,309,727, the focus is on being able to raise and lower the entire mousehole (main body) itself, to ensure unimpeded crane movement above the cellar deck and below the drill floor deck. Further, the winch in this patent is located below the rig floor and is permanently installed onto the rig. U.S. Pat. No. 6,209,851 discloses a drill floor hole comprising a through-going vertical opening in a drill floor (i.e. sleeve). A pipe holder (vertically float assembly) is mounted so as to be capable of vertical movement below the opening. The pipe holder is suspended in a pulley loop in a wire drive wherein one end of a wire rope is attached to the sleeve directly below the rig floor, then runs down and over the pulley loop portion of the pipe holder and then up to second pulley, which is affixed to the sleeve and then passes down to a winch which is affixed to the cellar deck beneath the rig floor. Further, the winch in this patent is located on the cellar deck which is the deck below the rig floor and is a permanent installation whereas the present system places the winch above the rig floor and hence creates a mobile piece of equipment that does not require modification to the rig to use.

U.S. Pat. No. 7,677,856 discloses a drill floor device which has two or more mouseholes for assembly and disassembly of pipe string sections. The mouseholes are arranged to be laterally displaced underneath the drill floor by a drive system and positioned under a hole or an opening in the drill floor. At least one of the mouseholes is provided with an elevator arranged to raise and lower a pipe or a pipe string section located in the mousehole, between an upper working position in which the upper end of the pipe/pipe string section projects above the drill floor and a lower position of rest in which the upper end of the pipe/pipe string section is below the drill floor.

U.S. Pat. No. 5,468,121 discloses an apparatus and method for positioning drill pipe within a mousehole. The apparatus includes a lifting member (float assembly in the present invention) positioned by an elevator disposed at a bottom end of a mousehole wherein the member abuts the pipe from beneath. The elevator can comprise an expandable bladder or a carriage lifted by a cable. By engaging the elevator, the position of the lifting member and therefore the upper end of the pipe can be raised a sufficient degree above the top end of the mousehole to apply a pipe tool around the pipe upper end.

U.S. Pat. No. 2,999,605 discloses an apparatus and method for securing and raising the drill pipe inside the mousehole. It comprises of support (270) adapted to move inside the mousehole. The support has series of rollers that passes the cable over it. The cable is provided by winch (284) and once the cable is fed around the rollers (278) located on the support means, the free end of the cable turns upward and is attached at an "anchorage" (276) within the mousehole. Accordingly, the support can be moved vertically inside the mousehole with the drill pipe resting on it and moving vertically with the support. The winch is permanently affixed to the mousehole and is located below the rig floor and as well the anchorage point for the cable is permanently attached to the interior of the mousehole whereas the present apparatus places a winch and a cable anchorage point above the rig floor on a portable structure that can be temporarily located above the rig floor and hence creates a mobile piece of equipment that does not require modification to the rig to use.

EFC (Electro Flow Control) Ltd uses a hydraulic cylinder with wire rope as an amplifier of the stroke to move the "rabbit" (vertically float assembly) up and down the mousehole whereas the present apparatus places a winch above the rig floor and hence creates a mobile piece of equipment that does not require modification to the rig to use.

SUMMARY

A portable apparatus for vertically positioning tubulars in a mousehole of a drilling rig is disclosed. The apparatus comprises a main body which includes a winch and an anchor point and a float assembly suspended within the mousehole below the main body. A cable is wound onto the winch and extends downward into the mousehole traversing the mousehole at the float assembly and then extend upward to and attach to the anchor point on the main body.

A portable stand building winch apparatus for vertical positioning of tubular pipe joint in an opening on a rig floor is disclosed. The apparatus includes a main body mounted on the rig floor. A winch is positioned in the main body above the rig floor along with an anchor point for the free end of the cable coming off of the winch. A float assembly is placed within the rig's mousehole at the bottom of the apparatus below the rig floor. The main body and the float assembly are connected through the cable which is fed in and out of the winch. The apparatus can be temporarily installed onto an existing rig without the need for modification of the rig or the rig's mousehole.

A method for vertical positioning of tubular pipe joint on a rig floor adjacent to a wellbore is also disclosed. The method includes installing a portable stand building winch apparatus at an opening on the rig floor without modifying the rig or the opening, wherein the portable stand building winch apparatus comprises a main body and a float assembly at the bottom of the apparatus; introducing a tubular pipe joint into the main body of the apparatus so that the lower end of the tubular pipe joint rests on a float assembly; and moving the float assembly to adjust the depth of the opening so that the desired length of the pipe joint protrudes above the rig floor.

The foregoing summary is intended merely to introduce a subset of the features more fully described of the following detailed description. Accordingly, this summary should not be considered limiting.

BRIEF DESCRIPTION OF THE DRAWINGS

The accompanying drawings, which are incorporated in and constitutes a part of this specification, illustrates an embodiment of the present teachings and together with the description, serves to explain the principles of the present teachings. In the figures:

FIG. 4(A) depicts a perspective view of another embodiment of the portable stand building winch apparatus with a fixed beveled ring.

Figure 1:
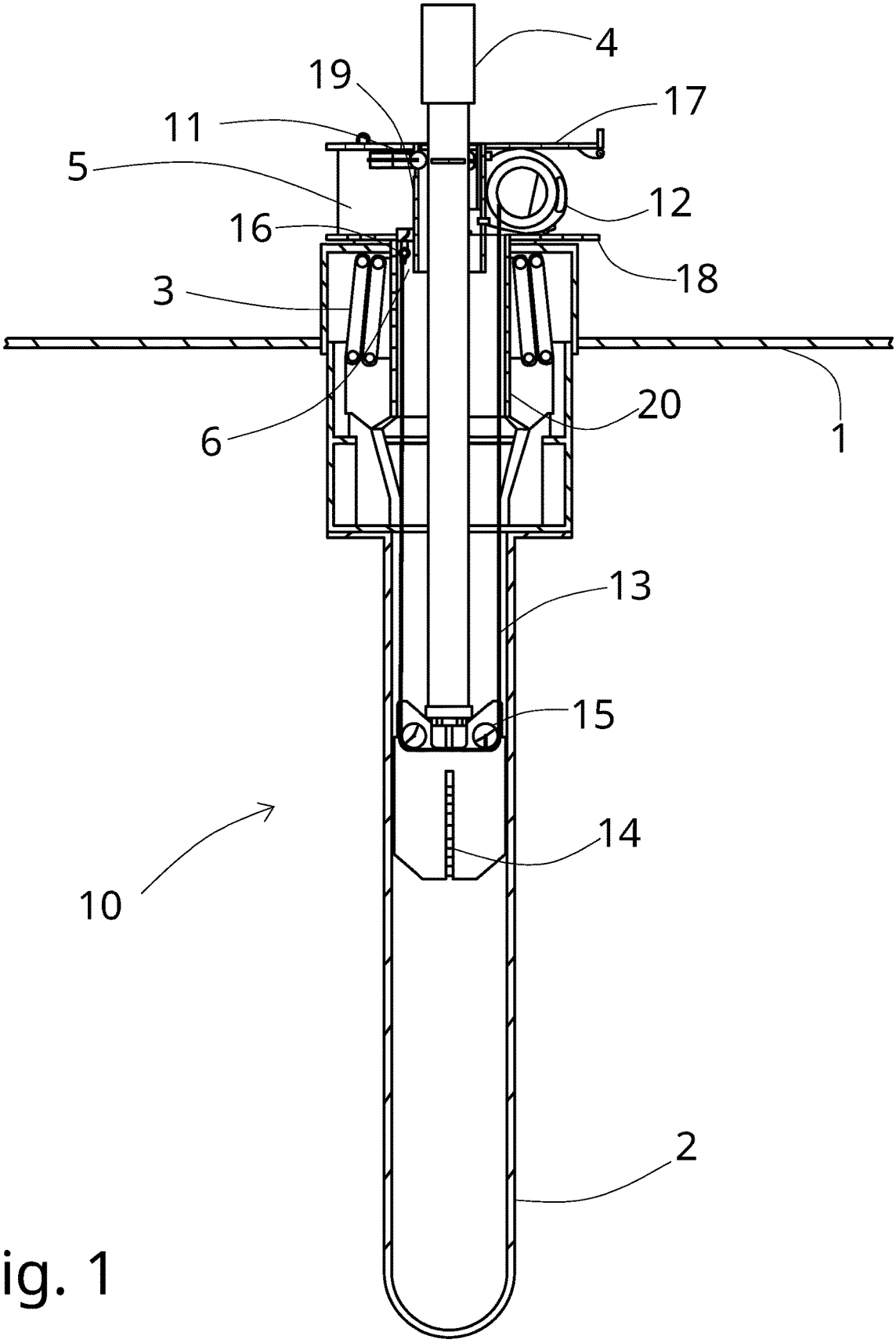
FIG. 1 depicts a side sectional view of a portable stand building winch apparatus installed in a mousehole opening on a rig floor, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

The apparatus includes a portable stand building winch apparatus installed in an existing mousehole opening or in an auxiliary rotary table on a rig floor adjacent to a wellbore.

This apparatus may avoid the use of slips for gripping and vertically supporting the pipe in the mousehole, which eliminates the possibility of damaging the pipe surface via the gripping inserts used in slip type gripping tools.

The apparatus can be lowered as an assembly into the mousehole sock of any rig which is not equipped with an integrated system for lowering and raising a stop in the mousehole sock of the rig. In at least some embodiments, the apparatus does not require any modifications to the rig, the rig mousehole, or the mousehole sock. A device for vertically moving the stop with this apparatus includes a winch which is located above the rig floor. The winch reels in and reels out a cable which interacts with the float (vertically moveable stop) directly which in turn raises and lowers the float in the sleeve. With the winch assembly being located above the rig floor, this apparatus can be temporarily installed in existing mouseholes on most rigs without the need for modifications to the rig or the mousehole sleeve, i.e., it may not disturb the environment, whereas conventional systems often require custom modification to the mousehole or other portions of the rig and in some cases requires a completely new mousehole sleeve.

At least some embodiments of the present apparatus differ from U.S. Pat. No. 9,309,727 at least in that the present apparatus raises and lowers tubulars while inside of the mousehole tube, and the '727 system raises and lowers the mousehole tube (sleeve) itself. Further, at least some embodiments of the present apparatus places the winch above the rig floor and hence creates a mobile piece of equipment that does not require modification to the rig to install or use the apparatus. In some embodiments, the apparatus may not lock the float assembly into the sock or elevate the entire sock as does the '727 system.

At least some embodiments of the present apparatus differ from U.S. Pat. No. 6,209,851 at least in that the present apparatus has the winch mounted on the structural portion that is located above the rig floor as well as the anchor point for the free end of the wire rope is also located on this structure.

At least some embodiments of the present apparatus differ from U.S. Pat. No. 7,677,856 at least in that the present apparatus applies to only one mousehole at a time (e.g., not two or more, in some embodiments) and the present apparatus may not include a drive system for laterally positioning a mousehole under a hole in the drill floor. Further, the drive system for raising and lowering the pipe support in one of the multiple mouseholes in U.S. Pat. No. 7,677,856 is a hydraulic cylinder (10) that is positioned axially below one of the mouseholes and is a permanent portion of the rig's mousehole system.

Figure 5:
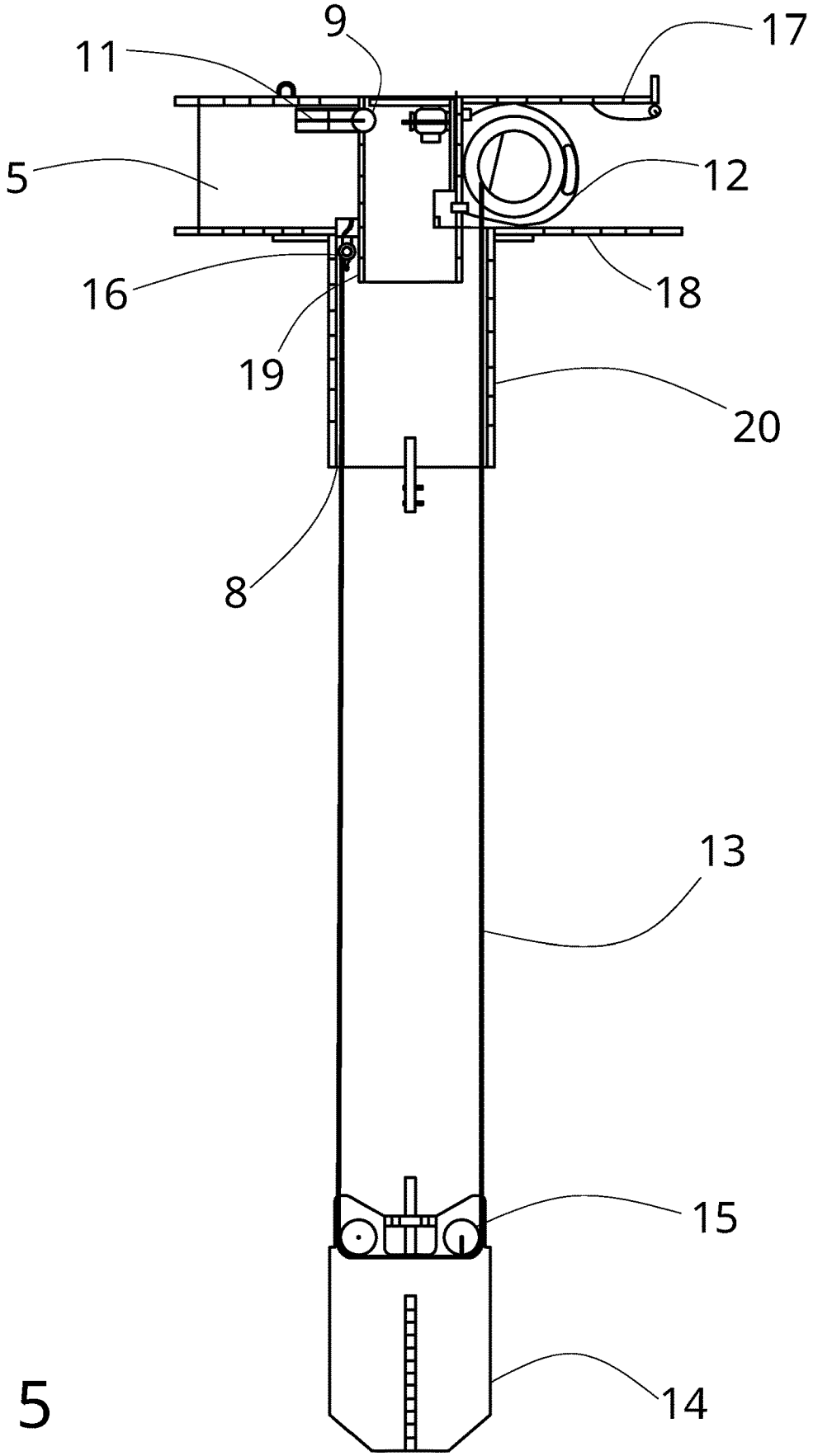
FIG. 5 depicts another perspective view of the portable stand building winch apparatus with the cable connecting the float assembly to the structure which is located above the rig floor.

The device depicted in FIG. 5 of U.S. Pat No. 5,468,121 is a mousehole system with a moveable stop (204). Contrasts between the system depicted in FIG. 5 and at least some embodiments of the present apparatus including the following: The system depicted in FIG. 5 includes a winch (214) which is permanently affixed to the rig structure above the rig floor. The system depicted in FIG. 5 has the terminal end of the wire rope that is fed off of the winch (214) attached to the exterior of the mousehole sock at attachment point (210). Wire rope (206) is fed off of the winch and drops beneath the rig floor and runs vertically downward at the exterior to the mousehole sock. The wire rope turns angularly downward at (216b) and runs through a slot in the mousehole where the wire rope interfaces with pulley (208). The wire rope after departing contact with pulley (208) runs angularly upward through a second slot in the sock to (216a) and then turn vertically upward and terminates at attachment point (210). The majority of the wire rope routing in this system is outside of the mousehole sock. At least some embodiments of the present apparatus differ from the system shown in FIG. 5 of the '121 patent at least in that each of the characteristics listed above point to the system of FIG. 5 being a permanent installation onto a rig with accompanying modifications to the mousehole slot in the form of the slots also pointing to this system being a permanent modification to the rig. By contrast, at least some embodiments of the present apparatus does not require any of the permanent attachments and alterations to the rig characterized by the FIG. 5 system.

FIG. 1 shows a side sectional view of a portable stand building winch apparatus 10 installed in an existing mousehole opening on a rig floor 1 and lowered into a mousehole sock 2. A single joint of pipe 4 is supported vertically in the portable stand building winch apparatus 10. The slips 3 in the mousehole assembly may or may not be present. The apparatus 10 described herein avoids the use of slips for gripping and supporting the pipe, which eliminates potentially damaging the pipe surface via the gripping inserts.

The apparatus 10 includes a main body 5 having a top plate 17 and bottom plate 18. The main body 5 includes coaxially-placed inner body 19 and outer body 20. The inner body 19 is coupled to (e.g., welded with) the top plate 17 and similarly, the outer body 20 is coupled to (e.g., welded with) the bottom plate 18. The outer body 20 axially and radially aligns the apparatus 10 into the rig's mousehole and the inner body 19 aligns the tubular joint 4 in the mousehole. The bottom body plate 18 rests on the mousehole and transfers the vertical load of the apparatus and the tubular being supported to it. The top body plate 17 provides protection and a clear work area.

In the illustrated embodiment, a winch 12 is positioned above the rig floor 1, for example, between the top plate 17 and the bottom plate 18. The winch 12 can be an air winch, electric winch, hydraulic winch or any other type of winch. The effective depth of the mousehole can be adjusted by the winch 12 paying out or reeling in a winch cable or wire rope 13 to vertically adjust the vertical position of the float assembly 14, thus providing a support for tubulars or stands of different lengths, while having the same amount of pipe stick up above the rig floor 1. The winch cable or wire rope 13 passes through the annulus 6 between the outer body 20 and the inner body 19. One end of the winch cable or wire rope 13 is secured at the static anchor point 16 inside the main body 5 and the other end of the winch cable or wire rope 13 is wound onto the winch 12. The winch 12 may be configured to vertically move the float assembly 14, such that the float assembly 14 is configured to position tubulars or stands of variable length such that a top of the tubular or stand is positioned at a certain height above the rig floor 1.

The main body 5 is stationary and does not move with respect to the rig floor or the tubular pipe joint 4. The cable 13 and winch 12 are sized to accommodate shock loading and relieve excess loads. The load rating of the cable 13 and winch 12 should be chosen to accommodate for any shock loading which may occur as a result of tubular falling through the mousehole and impacting the float assembly 14.

The lower end of the tubular pipe joint 4 shown supported in the apparatus 10 rests on a float assembly 14 inside the mousehole sock 2. The float assembly 14 includes at least one sheave or pulley 15 near the top thereof, such that the float assembly 14 is stable, as the center of gravity is below the pulleys 15.

Figure 2:
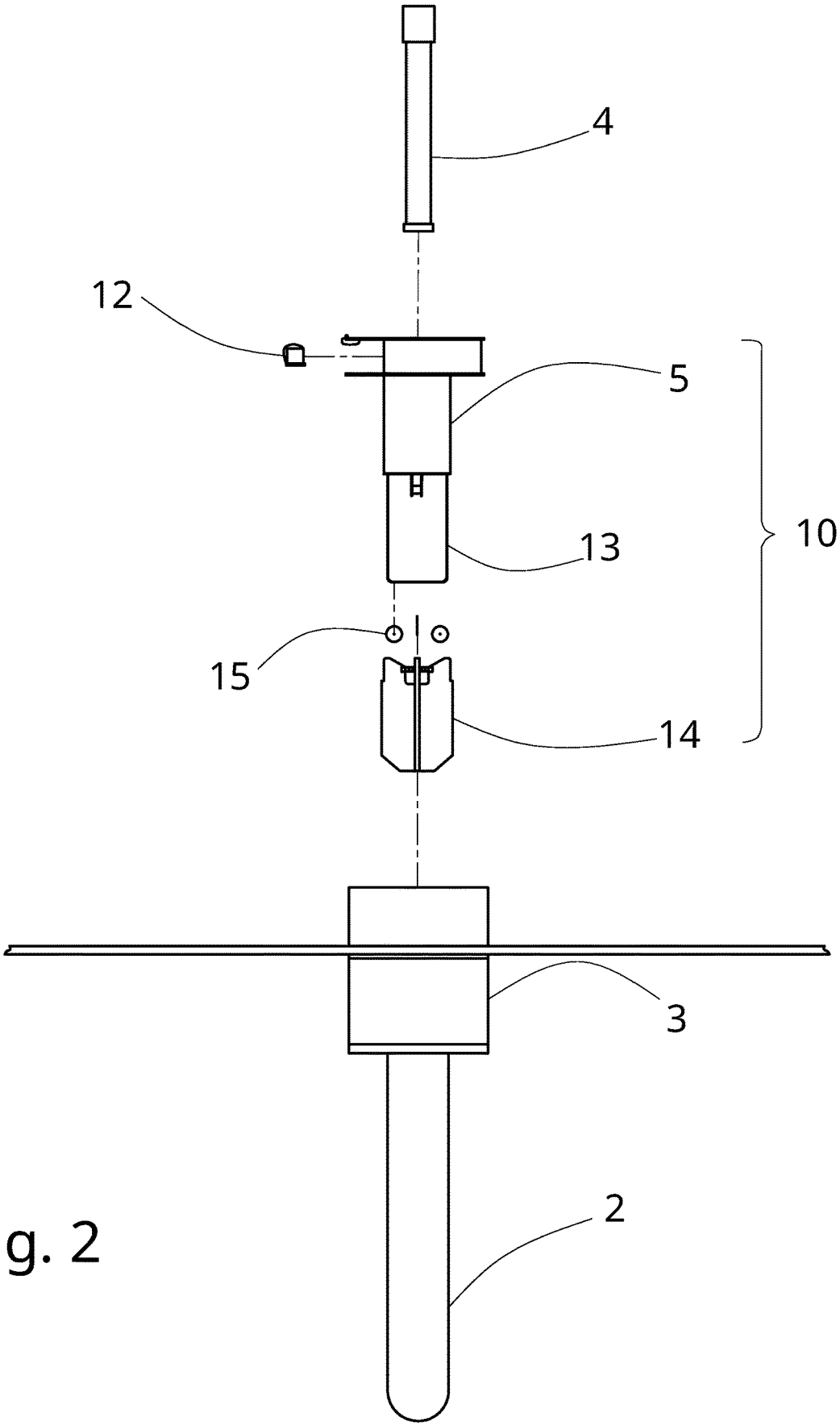
FIG. 2 depicts an exploded sectional view of the disassembled apparatus wherein the portable stand building winch apparatus has not been assembled.
Figure 3:
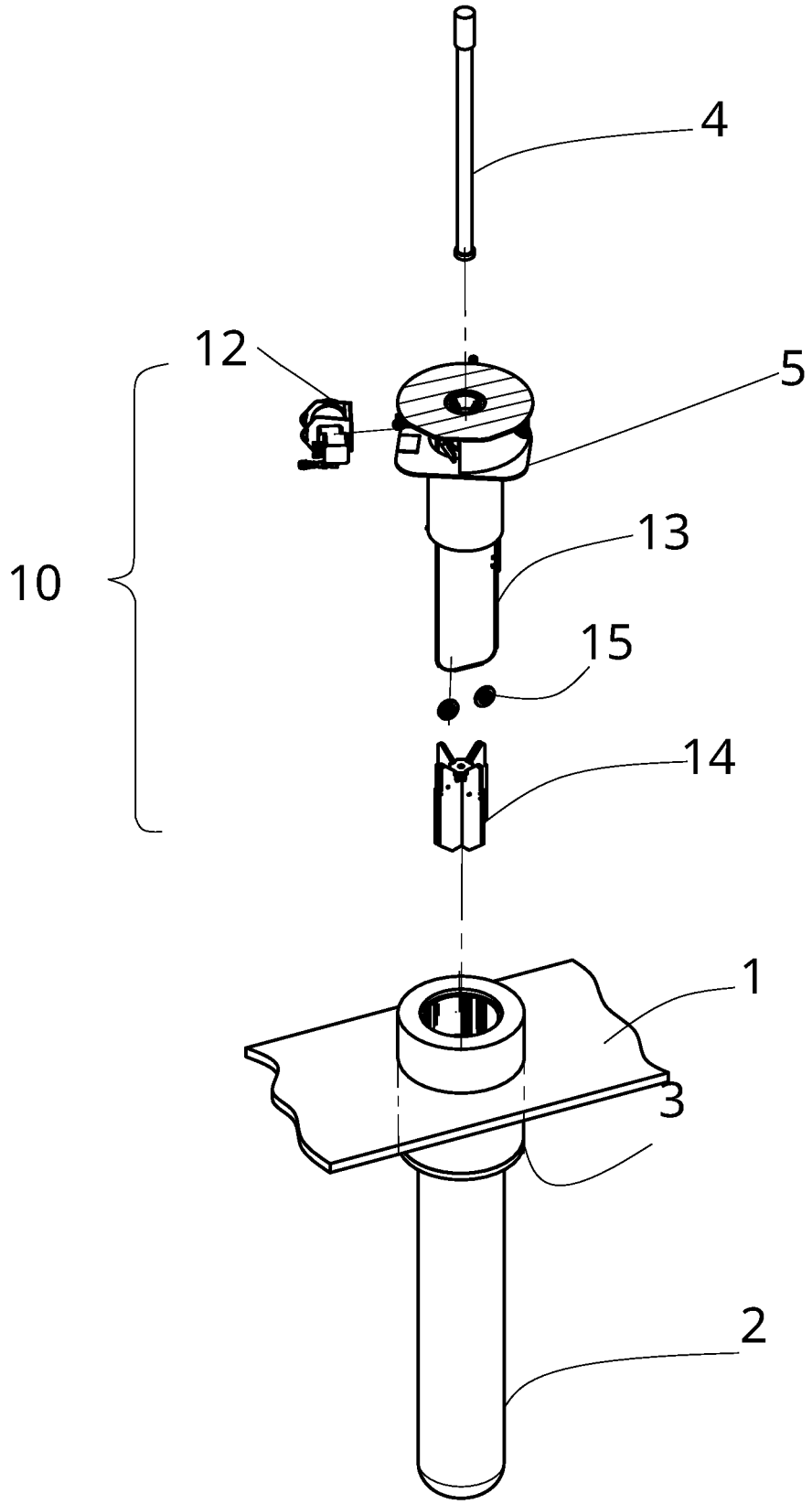
FIG. 3 depicts another exploded view of the disassembled apparatus wherein the portable stand building winch and associated cable have not been installed. The partially assembled apparatus is shown above the rig floor opening.

FIGS. 2 and 3 are exploded views of the disassembled apparatus. In these views, the portable stand building winch apparatus 10 has not been fully assembled or installed in the mousehole sock.

Figure 4:
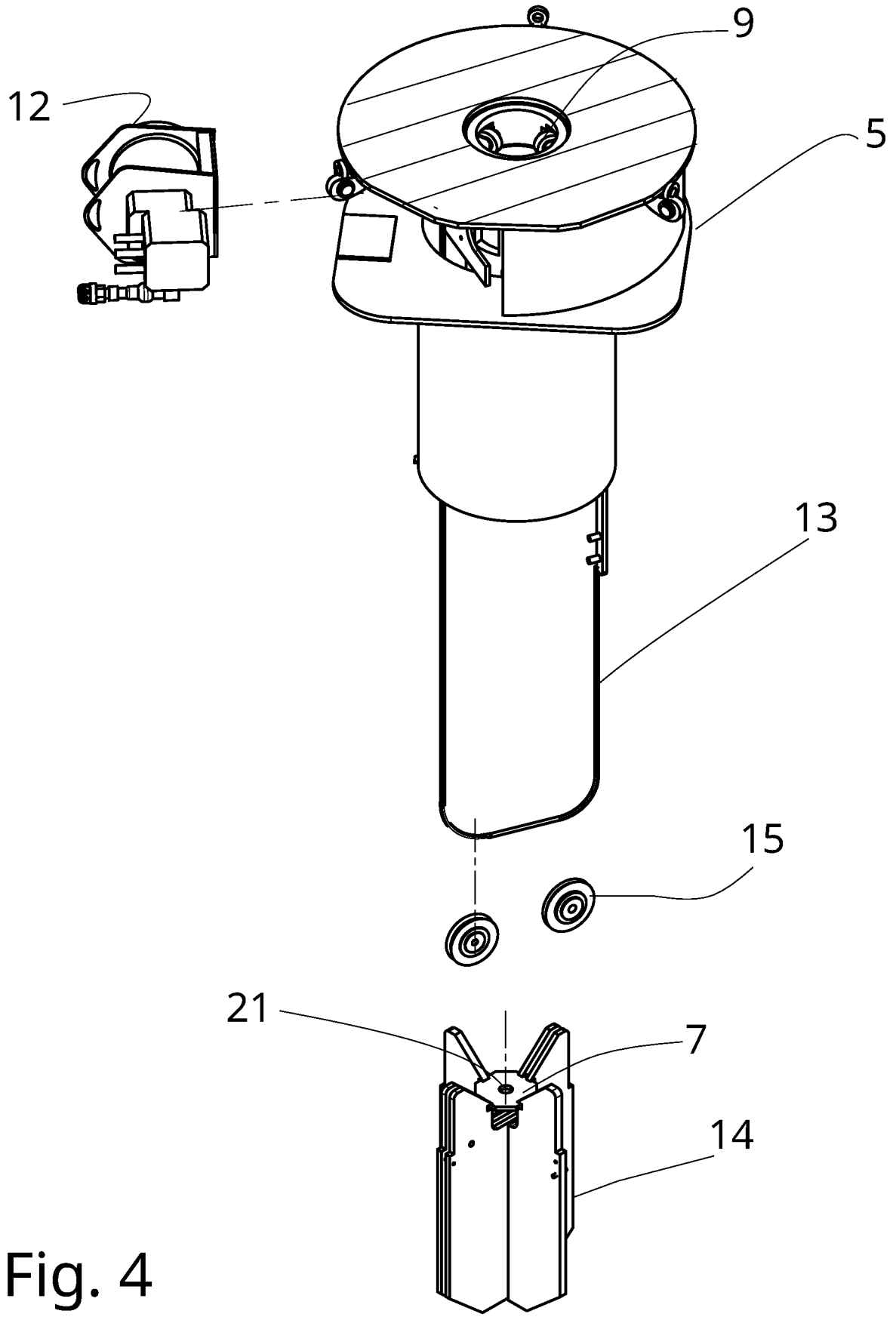
FIG. 4 depicts a perspective view of the portable stand building winch apparatus without the rig components.
Figure 4:
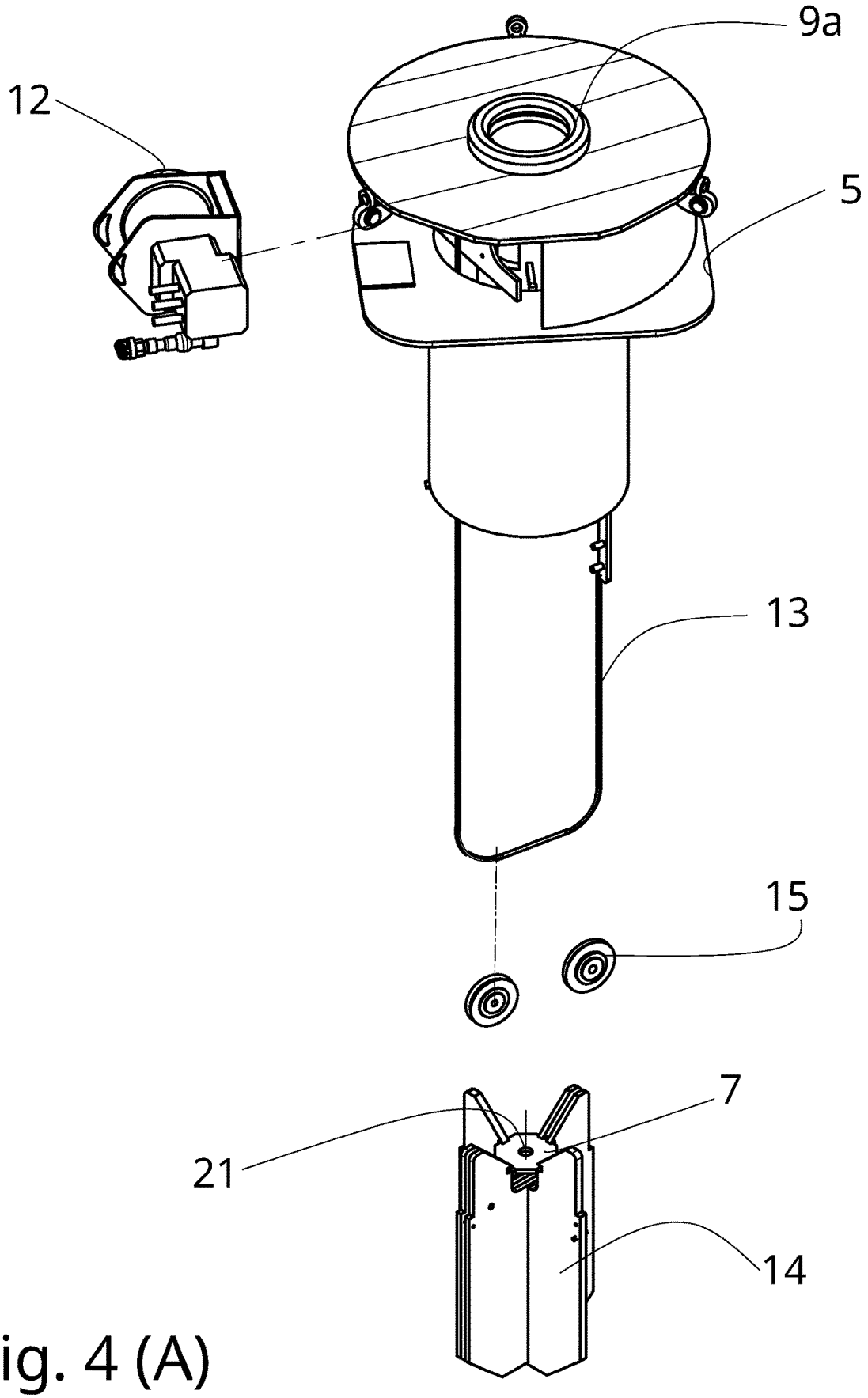

FIG. 4 is a perspective view of the portable stand building winch apparatus 10 without the rig floor and sock In this embodiment, the float assembly 14 is a four-blade structure. For example, the float assembly 14 may be a cross when viewed in plan view, so as to be stable in the mousehole bore. The float assembly 14 has sufficient length compared to its diameter so as to be stable in the mousehole bore. At the top of the float assembly 14, an inverted cone shape is created to centralize the pipe. There is a hole 21 in the top surface 7 of the float assembly 14 to allow for easy "fishing" should it become detached.

The pipe may be centralized or guided by a guiding device 11 positioned below the top plate 17 in one embodiment. The guiding device 11 may include two or more spring loaded guide rollers wheels 9, which extend inwards from the inner diameter of the main body 5 and are biased inwards to keep the pipe centered for different pipe sizes and allow the coupling or thread protector to pass. In the illustrated embodiment, there are three guide rollers 9. The guide rollers 9 may be non-metallic rollers. The guide rollers 9 may be manufactured from any suitable material such as plastics, rubber or a combination thereof. In another embodiment as shown in FIG. 4A, guiding device may be a fixed beveled ring 9*a* on the top of the main body 5. The beveled ring 9*a* may be manufactured from plastic, aluminum, or a combination thereof.

As shown in FIG. 5, the cable 13 is attached to static anchor point 16 inside the main body 5. From the anchor point 16, the cable 13 extends downward and passes between the inner body 19 and outer body 20, exits the bottom 8 of the main body 5, passes around the pulleys 15 at the top of the float assembly 14 and then extends upwards and re-enters the bottom of the main body 5 on the other side. From here the cable 13 passes between the inner body 19 and outer body 20 until it enters the winch 12. Therefore, reeling in and applying tension on the cable 13 with the winch 12 causes the float assembly 14 to rise and removing tension and reeling out cable 13 causes the float assembly 14 to lower. The pulleys 15 direct the cable 13 and allows the cable 13 to move freely, minimizing the friction and wear on the cable 13. The main body 5 and the float assembly 14 are connected through the cable 13.

The reeling in and reeling out of the cable 13 by the winch 12 vertically moves the float assembly 14 upward and downward respectively. The vertical movement of the float assembly 14 further results in the vertical movement of the tubular pipe joint 4 with respect to the main body 5.

Figure 6:
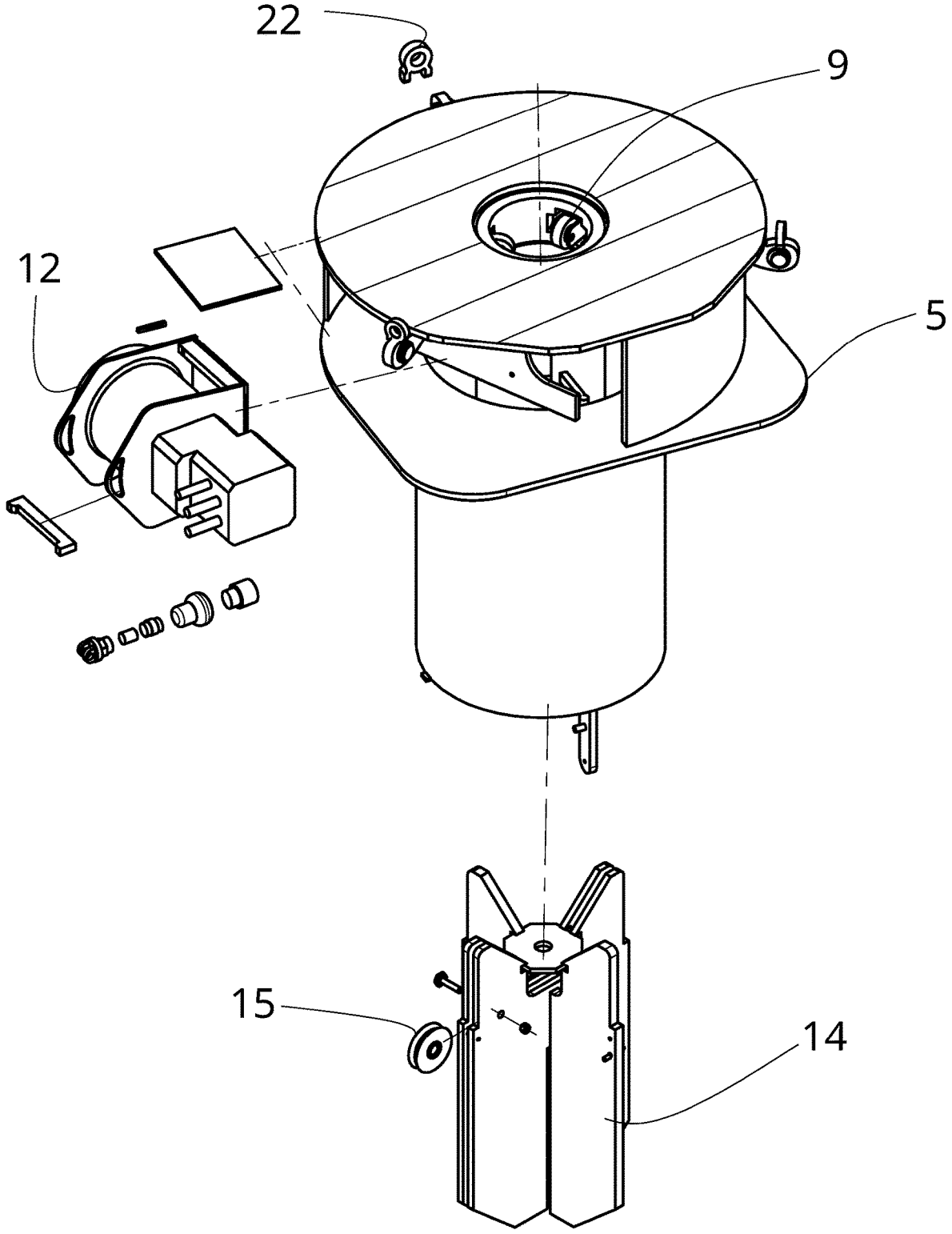
FIG. 6 depicts another view of the disassembled apparatus of portable stand building winch apparatus without the rig components. The float assembly is shown at some distance below the structure which will rest atop the rig floor.

FIG. 6 is an exploded view of the portable stand building winch apparatus 10 without the rig components. The main body 5 has shackles 22 on the top plate 17 for lifting the apparatus 10 to the rig floor 1 (see FIG. 1) and for placing the apparatus 10 such that it is vertically oriented and located such that it is aligned with the mousehole.

If a length of pipe is dropped into the mousehole during operations, then the cable 13 acts as a spring in the first instance. The winch 12 has a holding brake that acts as the secondary safety feature, as it is sized to slip before the cable 13 passes beyond its safe working load limit. The final safe guard is a spring at the bottom of the mousehole to reduce the shock.

In operation, a tubular handling device, e.g., elevator, introduces a new tubular pipe joint into the portable stand building winch apparatus 10. The tubular pipe joint 4 is lowered into the portable stand building winch apparatus 10 so that the pipe 4 does not interfere with the operations running on the rig floor 1. The depth of the mousehole is adjusted by vertically moving the float assembly 14 using the winch 12, thereby allowing for different length tubulars to be used, while ensuring that the same amount of pipe sticks up. For example, the float assembly 14 can be lowered to a position that lets the correct length of pipe protrude above the rig floor 1. If a segment of pipe of differing length is introduced into the mousehole, the winch 12 can be used to correct for the differing length of pipe by raising or lowering the float assembly 14, thus maintaining constant the length of pipe protruding above the rig floor 1.

To lower the tubular pipe joint into the mousehole, the winch 12 is activated to unwind the cable 13 (or otherwise lengthen the cable 13). As a result, the float assembly 14 is lowered into the mousehole. Since the lower end of the tubular pipe joint 4 (e.g., FIG. 3) rests on the float assembly 14, the tubular pipe joint 4 consequently, is also lowered. The tubular pipe joint 4 is then held in the mousehole in a vertical orientation. Once an additional tubular segment is added to the single tubular segment thus forming a "double stand", the winch 12 is used to unwind the cable 13 further, thus lowering the float assembly 14 such that the length of the assembled double stand is protruding above the rig floor 1 at a desirable elevation. Typical rig operations call for a third tubular segment to be added to the double stand that is supported in the mousehole thus forming a triple stand (i.e., an assembly of three tubular segments). Once a stand has been assembled, the stand is lifted out of the mousehole typically using a lifting elevator and an overhead lifting arrangement and the stand is subsequently moved to a portion of the rig structure that is dedicated to vertical storage of assembled tubular stands. The assembled stands are eventually moved from this storage area for assembly at well center into a contiguous tubular string.

Figure 7:
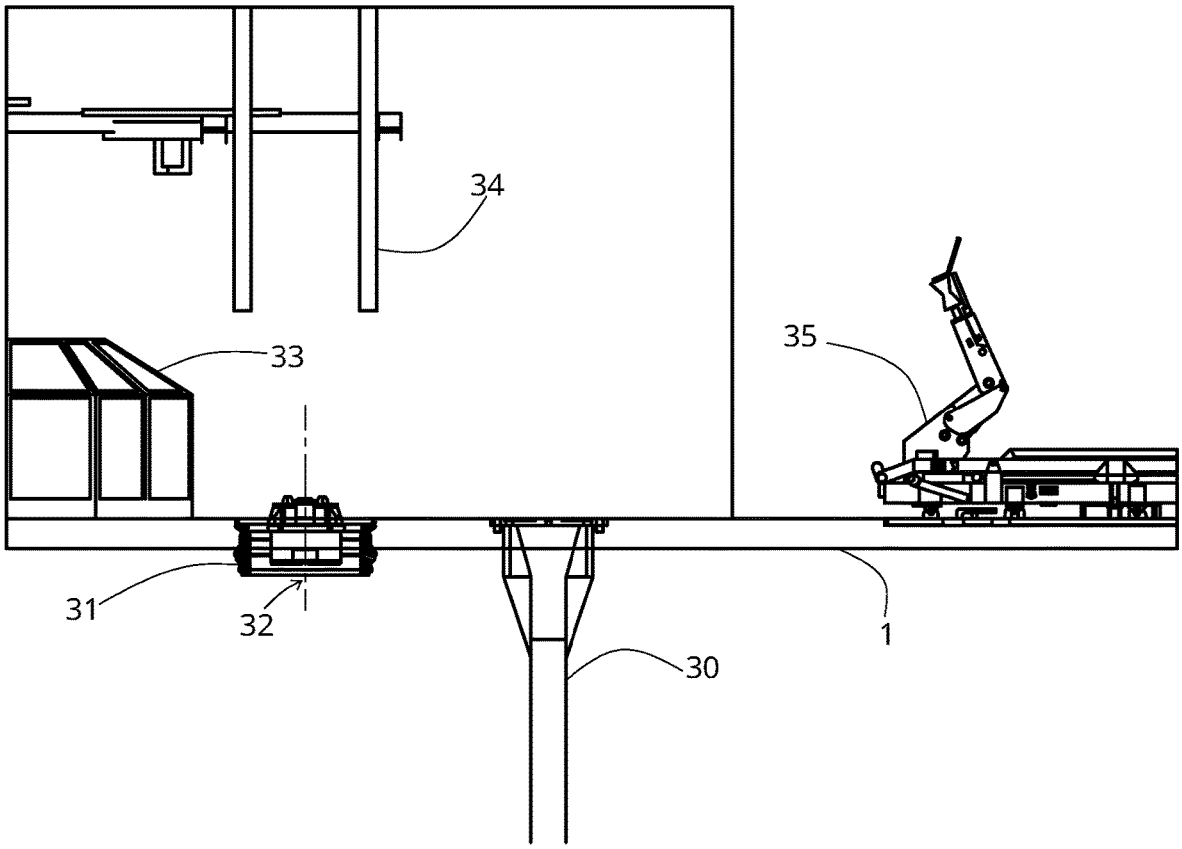
FIGS. 7(A)-7(I) depict a side view of typical rig floor and the present apparatus, showing various steps of installation of portable stand building winch apparatus in a mousehole.
Figure 7:
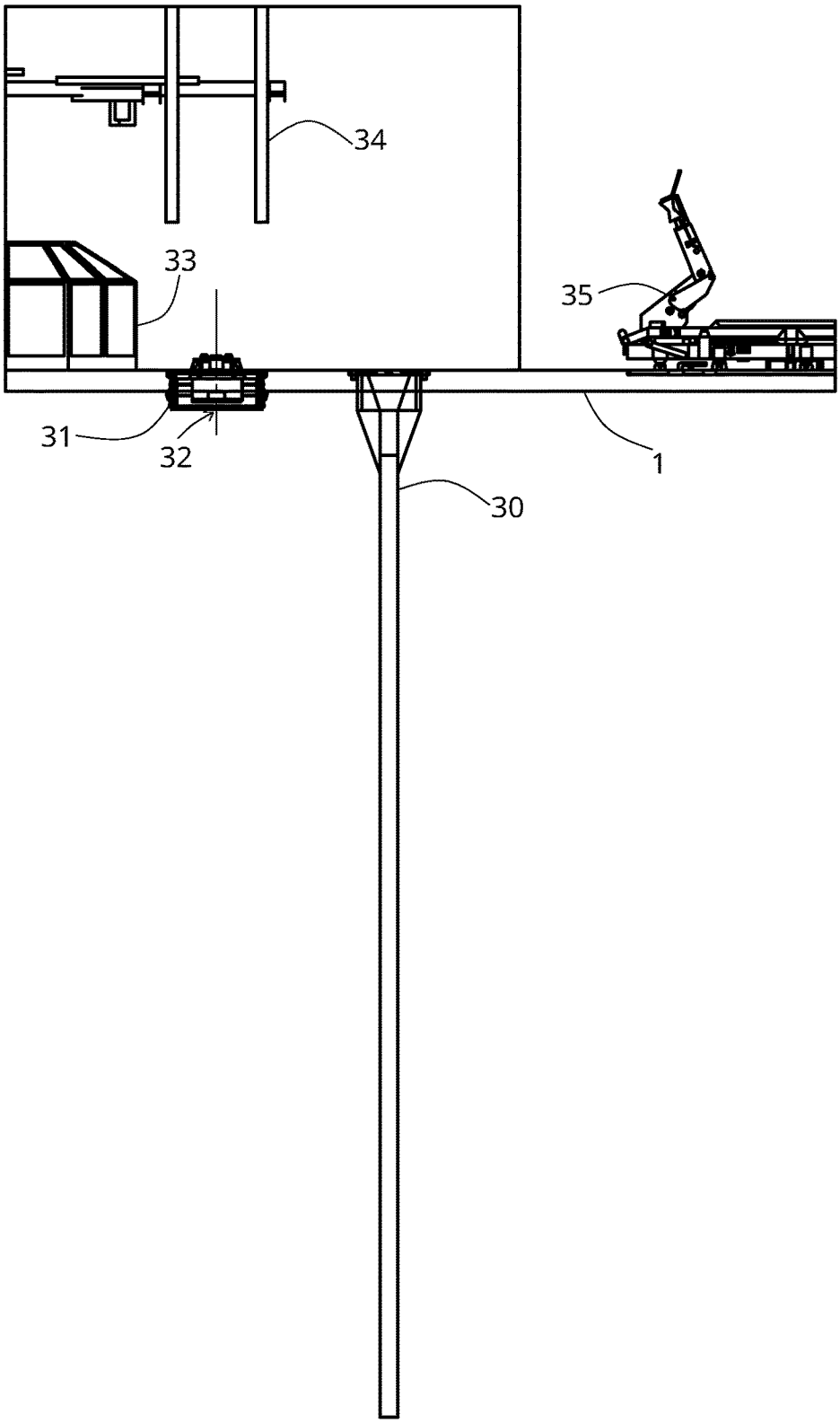
Figure 7:
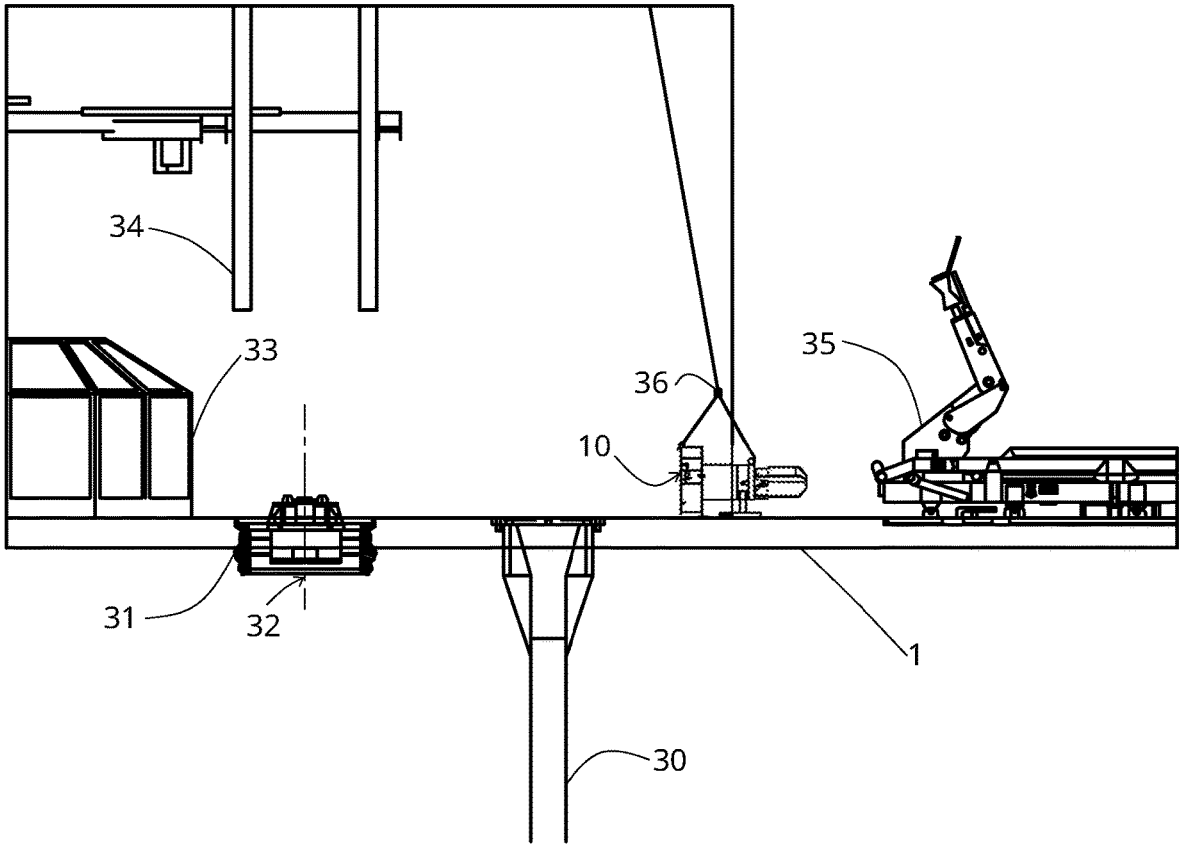
Figure 7:
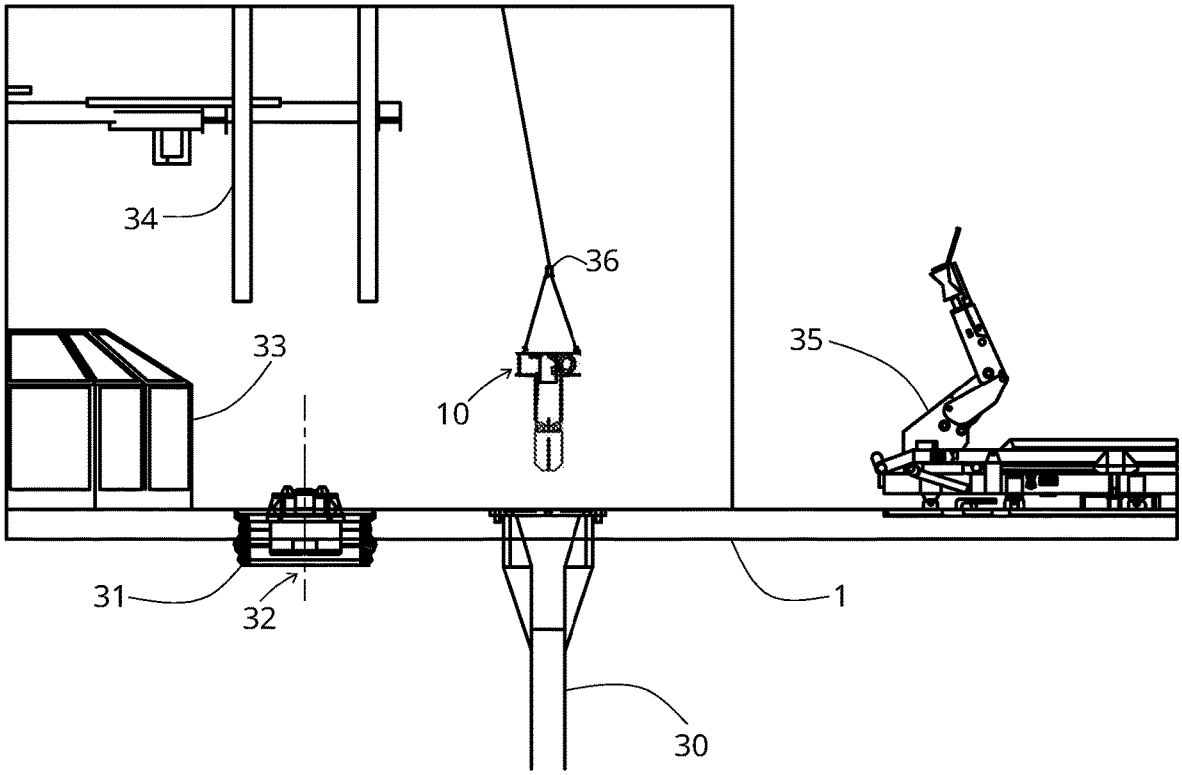
Figure 7:
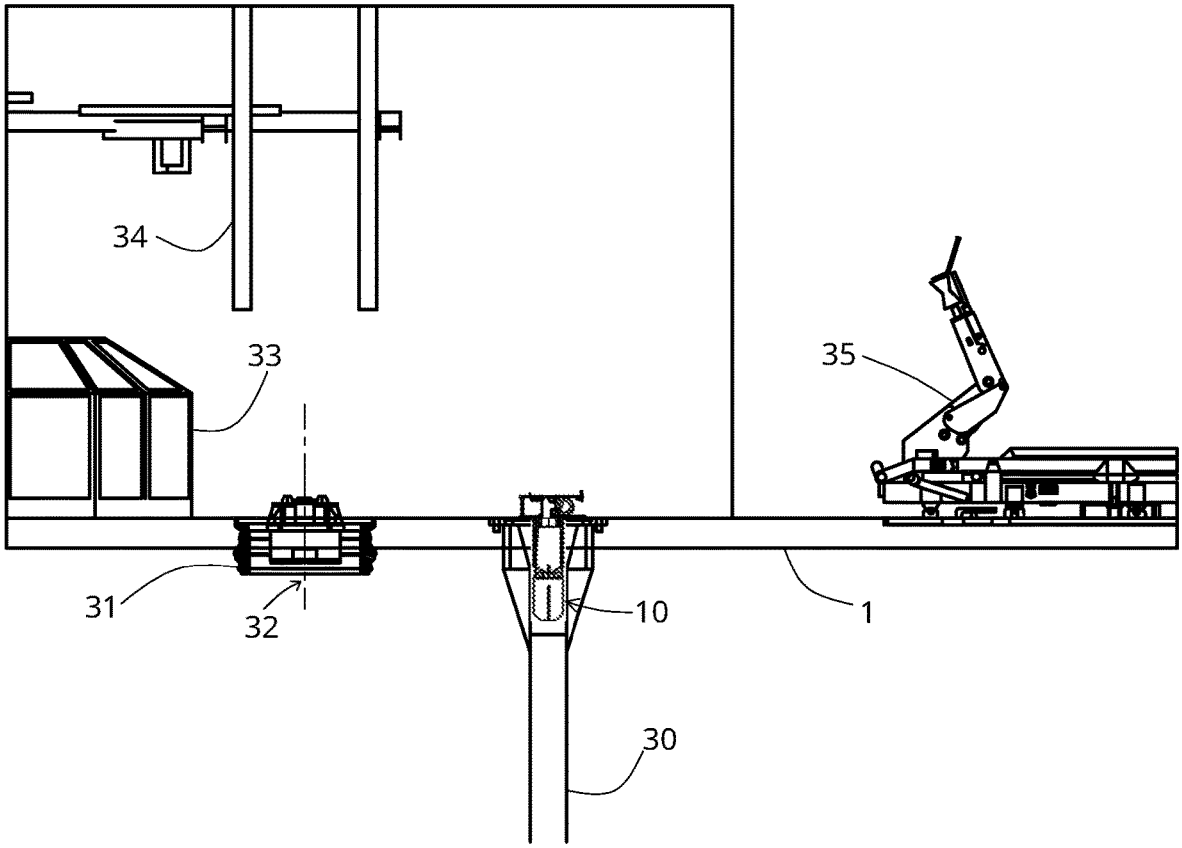
Figure 7:
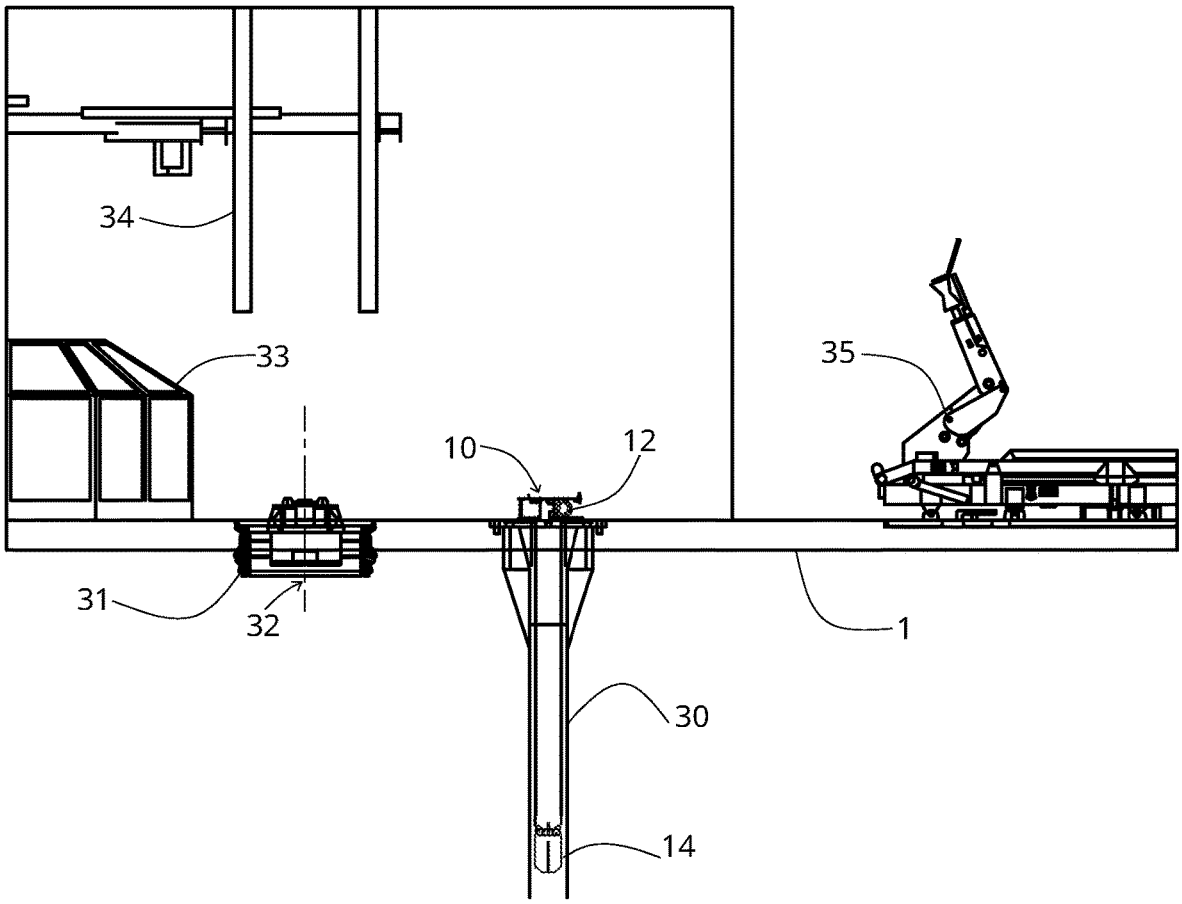
Figure 7:
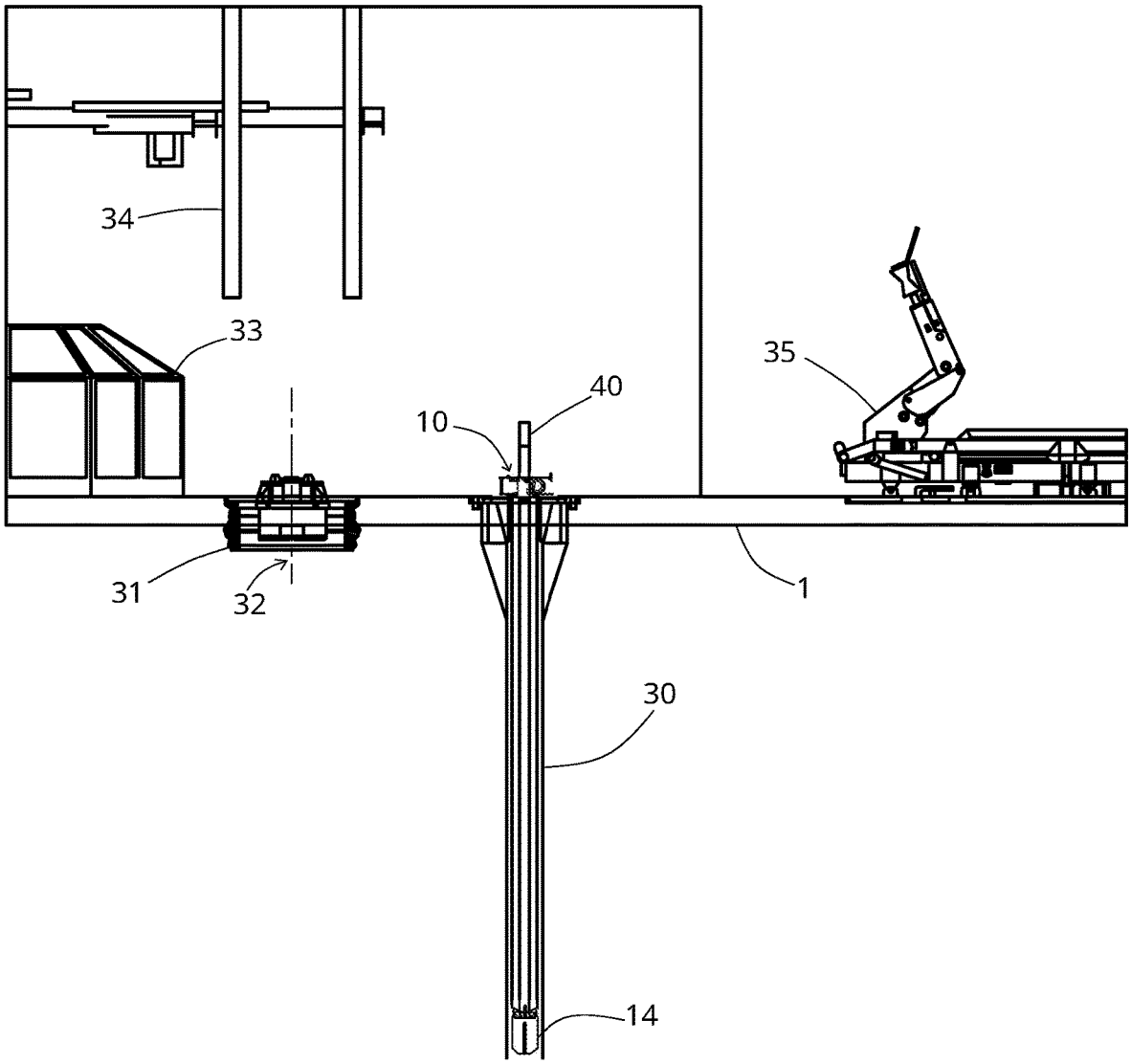
Figure 7:
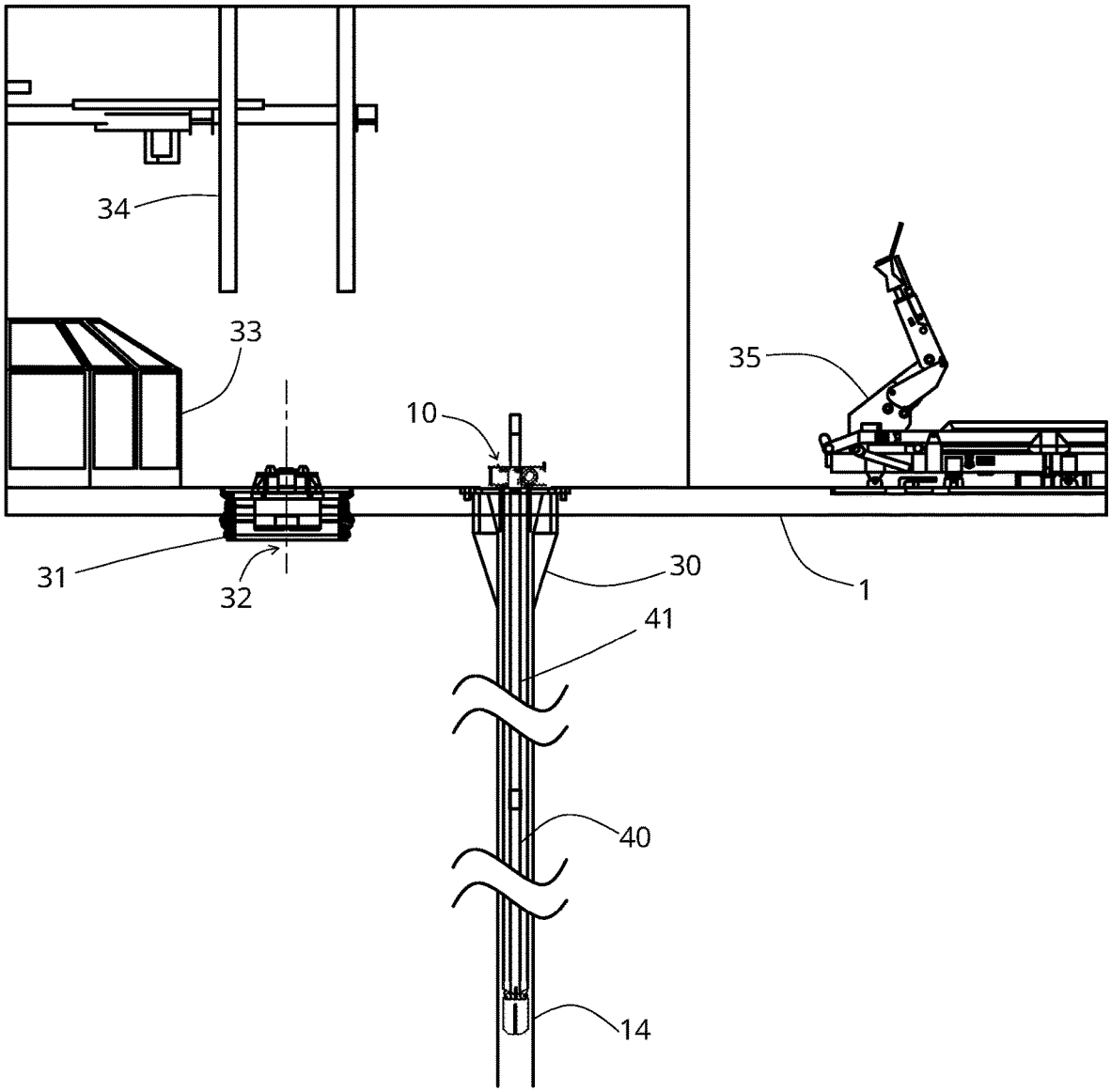
Figure 7:
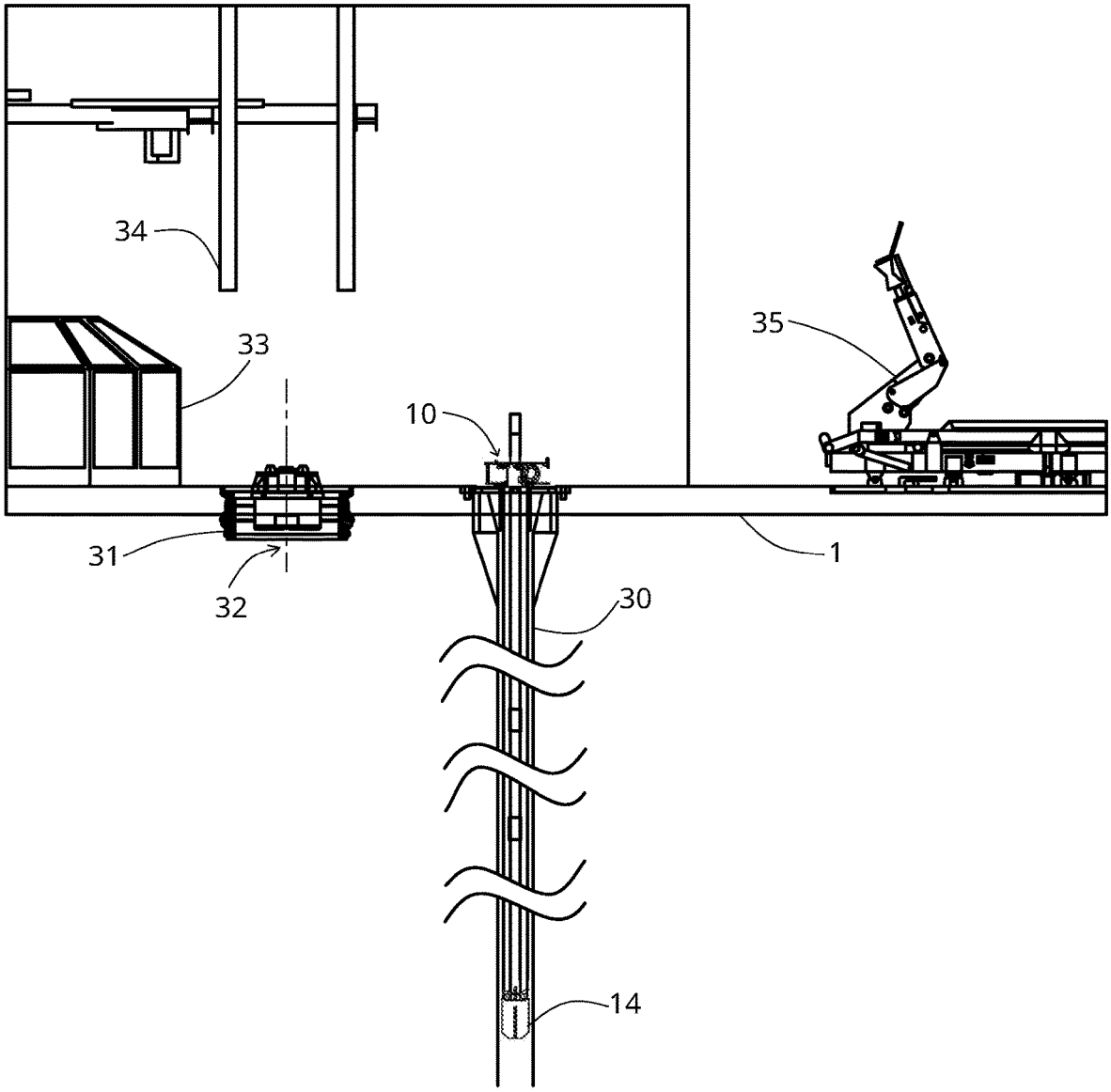

FIGS. 7(A)-7(I) depict a side view of typical rig floor 1. FIG. 7(A) shows the typical rig floor 1 structure before installation of portable stand building winch apparatus 10. The wellbore 32 and the mousehole 30 are adjacent on the rig floor 1. A rotary table 31 is installed in the wellbore 32 Above the wellbore 32, there are top drive rails 34 for vertical movement of a top drive. A drill shack 33 is placed near the rotary table 31. A pipe conveyor 35 is positioned on the rig floor 1 for guiding the tubular joint to the wellbore 32 or the mousehole 30. FIG. 7(B) depicts side view of rig floor 1, showing the entire depth of the mousehole 30.

In FIG. 7(C), a lifting apparatus 36 engages the portable stand building winch apparatus 10 in horizontal position to be transferred to the rig floor 1. In FIG. 7(D), the portable stand building winch apparatus 10 is still in the transport mode. The portable stand building winch apparatus 10 is moved to an upright vertical orientation for placement in the mousehole 30 by the lifting apparatus 36. In FIG. 7(E), the portable stand building winch apparatus 10, still in the transport mode, is installed into the mousehole 30. The lifting assembly 36 is then detached and removed from the portable stand building winch apparatus 10. FIG. 7(F) shows the portable stand building winch apparatus 10 in operating mode. In this view, the float assembly 14 has been lowered into the mousehole 30 via the winch 12.

Figure 8:
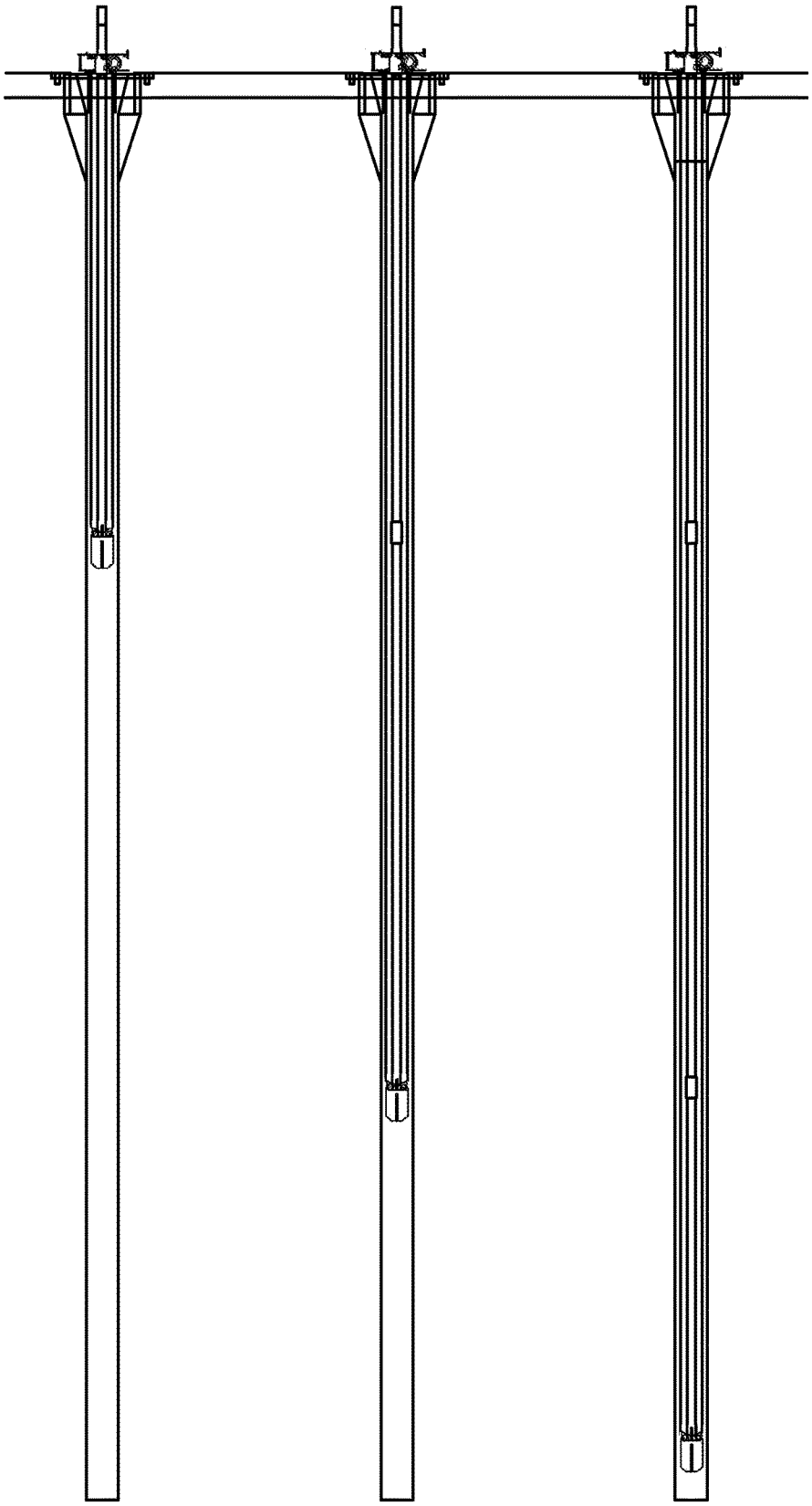
FIG. 8 depicts side by side comparison of float depth in the mousehole when supporting one tubular, two tubulars and three tubulars.

The portable stand building winch apparatus 10 with lowered float assembly 14 accommodates a single joint of tubular 40 as shown in FIG. 7(G). FIG. 7(H) shows the portable stand building winch apparatus 10 supporting two joints of tubulars joined together by a coupling. FIG. 7(I) shows the portable stand building winch apparatus 10 supporting three joints of tubulars joined together by couplings. FIG. 8 shows side by side comparison of float depth in the mousehole when supporting one tubular, two tubulars and three tubulars.

As used herein, the terms "inner" and "outer"; "up" and "down"; "upper" and "lower"; "upward" and "downward";

"above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A portable apparatus for vertically positioning tubulars in a mousehole of a drilling rig, comprising:

a main body including a winch and a cable anchor point, wherein the main body is configured to be supported on a rig floor and extend into the mousehole;

a float assembly configured to be suspended within the mousehole below the main body; and a cable wound onto the winch and configured to extend downward into the mousehole, traverse the mousehole at the float assembly and then extend upward to and attached to the cable anchor point on the main body.

2. The apparatus of claim 1, wherein the apparatus is configured to be inserted into a rig mousehole without modification to the rig or the mousehole.

3. The apparatus of claim 2, wherein the winch is configured to vertically move the float assembly, such that the float assembly is configured to position tubulars or stands of variable length such that a top of the tubular or stand is positioned at a predetermined height above the rig floor.

4. The apparatus of claim 1, wherein main body comprises a lifting connector, and wherein the main body and the float assembly are configured to be lowered at least partially into and lifted out of the mousehole as a single unit by a lifting device connected to the lifting connector.

5. The apparatus of claim 1, further comprising lifting the main body and the float assembly out of the mousehole as a single unit using a lifting device connected to the main body.

6. A portable stand building winch apparatus for vertical positioning of tubular pipe joint in an opening on a rig floor, comprising:

a main body supported on the rig floor adjacent to a wellbore, wherein a portion of the main body is received into the opening in the rig floor;

a winch positioned in the main body above the rig floor;

a float assembly received in the opening and positioned below the rig floor; and a cable connecting the winch and the float assembly, such that the winch is configured to raise and lower the float assembly with respect to the rig floor.

7. The apparatus of claim 6, wherein the main body comprises an outer body received at least partially into the opening and configured to align the apparatus with the opening, and an inner body configured to align a tubular joint received therethrough coaxially with the opening, the inner and outer bodies being coaxial.

8. The apparatus of claim 7, wherein the cable passes through an annulus between the outer body and the inner body.

9. The apparatus of claim 7, wherein the main body further comprises a top plate connected to the inner body and a bottom plate connected to the outer body, wherein the top plate and the bottom plate are vertically spaced apart.

10. The apparatus of claim 9, wherein the winch is positioned between the top plate and the bottom plate.

11. The apparatus of claim 9, wherein the bottom plate is configured to be supported on a slips assembly of a drilling rig or a top of a mousehole of the drilling rig, such that the main body is configured to be supported vertically by the slips assembly or the top of the mousehole.

12. The apparatus of claim 6, wherein one end of the cable is secured at a static anchor point in the main body and the other end of the cable is wound at the winch.

13. The apparatus of claim 6, wherein the float assembly comprises at least one pulley.

14. The apparatus of claim 6, wherein the main body remains stationary with respect to the rig floor, and the tubular pipe joint and the float assembly are movable with respect to the rig floor.

15. The apparatus of claim 6, wherein the float assembly moves vertically by winding or unwinding of the cable using the winch, wherein vertical movement of the float assembly causes vertical movement of the tubular.

16. The apparatus of claim 6, further comprising a guiding device coupled to the main body, wherein the guiding device is configured to centrally locate the tubular pipe joint.

17. The apparatus of claim 16, wherein the guiding device comprises two or more spring loaded guide rollers.

18. The apparatus of claim 17, wherein the guide rollers are manufactured from plastic, rubber, or a combination thereof.

19. The apparatus of claim 16, wherein the guiding device comprises a fixed beveled ring on the top of the main body.

20. The apparatus of claim 19, wherein the fixed beveled ring is manufactured from plastic, aluminum, or a combination thereof.

21. The apparatus of claim 6, wherein the winch comprises at least one of an air winch, an electric winch, or a hydraulic winch.

22. A method for vertically positioning a tubular pipe joint on a rig floor adjacent to a wellbore, comprising:

installing a portable stand building winch apparatus at least partially in an opening on the rig floor without modifying the rig or the opening, wherein the portable stand building winch apparatus comprises a main body, a winch, and a float assembly, wherein the winch is positioned at least partially above the rig floor;

introducing a tubular pipe joint or stand into the main body of the apparatus so that the lower end of the tubular pipe joint rests on the float assembly; and moving, using the winch, the float assembly to adjust a depth of the opening so that desired predetermined length of the pipe joint protrudes above the rig floor.

23. The method of claim 22, wherein the main body and the float assembly are connected by a cable.

24. The method of claim 23, wherein moving the float assembly comprises moving the float assembly vertically while the main body of the apparatus remains stationary, and wherein vertical movement of the float assembly causes vertical movement of the tubular.

25. The method of claim 22, further comprising securing one end of a cable to a static anchor point, wherein the other end of the cable is wound at the winch, and wherein the cable engages the float assembly so that operation of the winch raises or lowers the float assembly.

26. The method of claim 22, wherein introducing the tubular pipe joint into the main body of the apparatus comprises centering of the tubular pipe joint using a guiding device disposed on the main body.

27. The method of claim 26, wherein the guiding device comprises two or more spring loaded guide rollers.

28. The method of claim 27, wherein the guide rollers are manufactured from plastic, rubber, or a combination thereof.

29. The method of claim 26, wherein the guiding device comprises fixed beveled ring on the top of the main body.

30. The method of claim 29, wherein the fixed beveled ring is manufactured from plastic or aluminum or a combination thereof.

* * * * *